United States Patent [19]

Shepherd

[11] Patent Number: 4,718,663

[45] Date of Patent: Jan. 12, 1988

[54] EXERCISING APPARATUS

[76] Inventor: Keith E. Shepherd, 24 Palm Close, New Inn, Pontypool, Gwent. NP4 0DE, Great Britain

[21] Appl. No.: 826,351

[22] Filed: Feb. 5, 1986

[51] Int. Cl.[4] ..... A63B 21/06

[52] U.S. Cl. ..... 272/118

[58] Field of Search ..... 272/67, 68, 116, 117, 272/118, 119, 122, 123, 134, 130

[56] References Cited

U.S. PATENT DOCUMENTS

| | | | |
|---|---|---|---|
| 3,635,472 | 1/1972 | Marcyan | 272/118 |
| 3,647,209 | 3/1972 | La Lanne | 272/118 |
| 3,756,597 | 9/1973 | Monti | 272/123 |
| 4,199,139 | 4/1980 | Mahnke et al. | 272/118 |
| 4,199,140 | 4/1980 | Ferretti | 272/123 |
| 4,200,280 | 4/1980 | Goodwin | 272/118 |
| 4,346,888 | 8/1982 | Szabo | 272/118 |
| 4,515,364 | 5/1985 | Rotella | 272/122 X |
| 4,606,540 | 8/1986 | Chin-Sen | 272/118 |
| 4,624,457 | 11/1986 | Silberman et al. | 272/118 |

*Primary Examiner*—Richard J. Apley
*Assistant Examiner*—Robert W. Bahr
*Attorney, Agent, or Firm*—Young & Thompson

[57] ABSTRACT

Exercising apparatus comprises a main frame 1 providing a seat 3. A cable 7 leads from a bar to be raised or lowered by the arms or legs of the user, to a group of weight members 9 to be lifted. These weight members 9 comprise a closed rigid container with a filling opening allowing water or sand to be poured in to achieve a desired weight, the aperture then being closed by a cap. Each weight member is shaped at the sides to provide recesses to receive vertical guide tubes 10 and 11 and the undersurface of each weight member incorporates a guide slot for receipt of a locating rod which will be interconnected with a yoke 8 to which the cable 7 is attached, the arms of the yoke passing into passageways through each weight member 9.

6 Claims, 8 Drawing Figures

EXERCISING APPARATUS

This invention is concerned with exercising apparatus which enables a person to carry out a variety of exercises by moving weights mounted on a lifting or pulling apparatus.

It is an object of this invention to provide parts of such exercising apparatus which may readily be transported.

SUMMARY OF THE INVENTION

Accordingly, from one aspect this invention provides a weight member for exercising apparatus comprising a body formed with a top surface and an underneath surface, with passageways passing between the two surfaces to receive arms of a carrying member, and having recesses at the sides to accommodate guide members extending upwardly of a framework for the exercising apparatus, the lower surface of the body providing a guideway for a locating rod attached to the arms of the carrying member.

Such a weight member may readily be integrated within a support framework incorporating the necessary carrying member and guide members. A number of such weight members can be mounted within the framework and the user can select a chosen number of these weight members for attachment to the carrying member.

It is greatly preferred that the body of the weight member should comprise a hollow container provided with a removable closure cap. The weight member can then be filled, for example with water, to achieve a predetermined weight. Sand can also be used as a filling agent. When the weight member is empty it may be transported very easily, such as from the manufacturer to a retail outlet and by the purchaser to his home.

The guideway will ideally comprise a groove running across the lower surface of the body, so that the locating rod is tucked away into the weight member itself. The body may be formed from a rigid plastics material and, if necessary, could have a lower surface comprising an integral or separate metal plate to protect the structure of the body from undue stresses.

The invention also extends to an exercising apparatus comprising a support framework incorporating weight members of this invention as defined hereinbefore, positioned between guide members of the framework and having a carrying member for interconnection with the weight members and attached to a lifting cord, cable or the like.

The guide members will ideally comprise pairs of rods extending upwardly of the framework on both sides.

The exercising apparatus will preferably include a handlebar device attached to the end of the lifting cord. The handlebar device may include a reel on which can be wound excess portions of the cord and have a locking pin for securing the reel in a desired condition.

BRIEF DESCRIPTION OF THE DRAWINGS

The invention may be performed in various ways and a preferred embodiment thereof will now be described with reference to the accompanying drawings, in which.

DESCRIPTION OF THE PREFERRED EMBODIMENT

Figure 2:
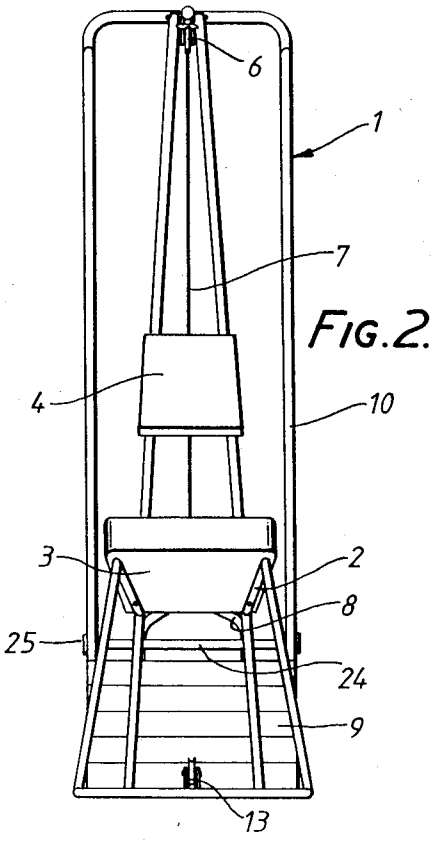
FIGS. 2 and 3 are respectively front and plan views of the apparatus shown in FIG. 1.
Figure 1:
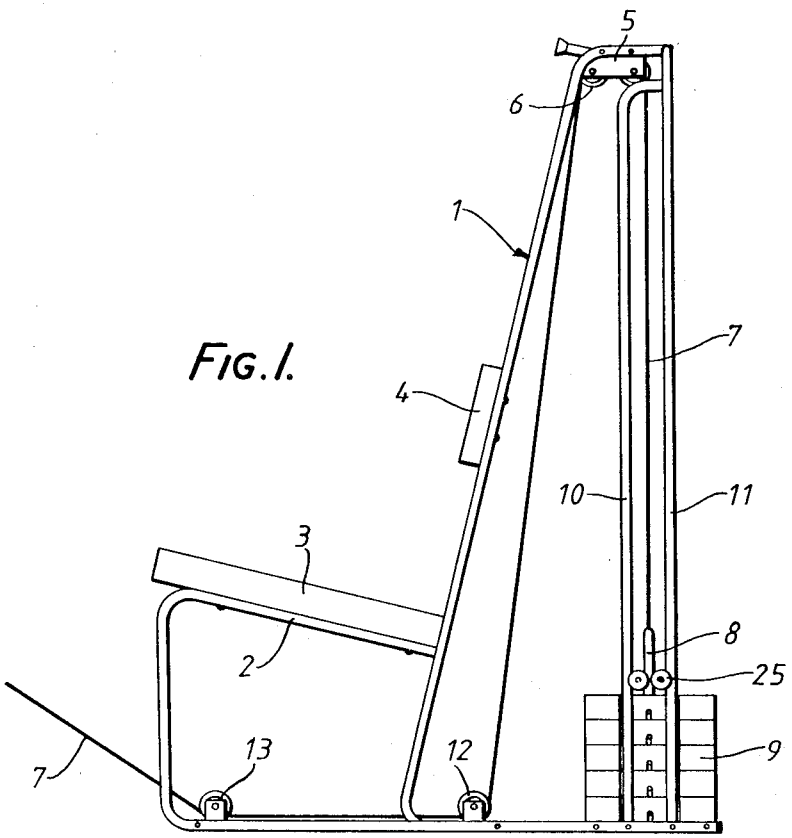
FIG. 1 is a side view of an exercising apparatus of this invention.
Figure 3:
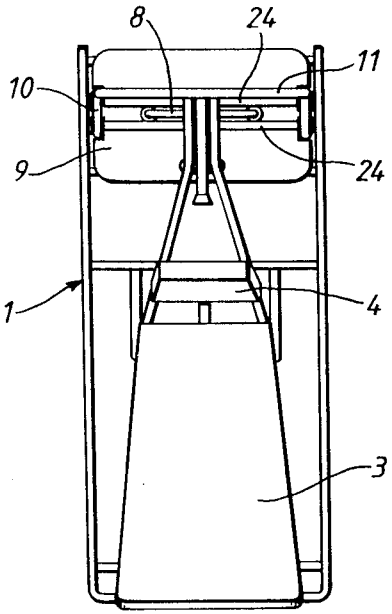

Referring firstly to FIGS. 1 to 3 of the drawings, there is illustrated an exercising apparatus comprising a main framework 1 formed from steel tube. The framework defines a seat 2 supporting a cushion 3 and an upright portion of the framework has a backrest 4 attached thereto. At the top of the framework 1 there is a mounting 5 for a pair of pulleys 6 over which runs a nylon cord 7 whose one end is attached to a lifting yoke 8. The lifting yoke 8 supports one or more of an array of weight members 9 in a manner as will be described hereinafter. The weight members 9 are mounted about guide tubes 10, 11 forming part of the framework 1.

The other end of the nylon cord 7 can follow one of three paths. Firstly it can run around two further pulleys 12, 13 (in the manner illustrated in FIG. 1) and will then be connected to the handlebar device shown in FIGS. 7 and 8. A person sitting on the seat 2 can then hook his feet around the handlebar device and raising and lowering of the lower part of his legs will lift the weight members 9 connected to the yoke 8. As an alternative the cord 7 can pass around the pulley 12 and then up between the cushion 3 and the backrest 4 to be attached to the handlebar device. A person sitting on the seat 2 facing the framework 1 can then carry out a lifting exercise by pulling the handlebar device upwards. As a further alternative the cord 7 can pass down from the pulleys 6 in front of the backrest 4 to be attached to the handlebar device. A person sitting on the seat 2 can then carry out a pulling exercise (whilst facing either towards or away from the main framework 1).

Figure 4:
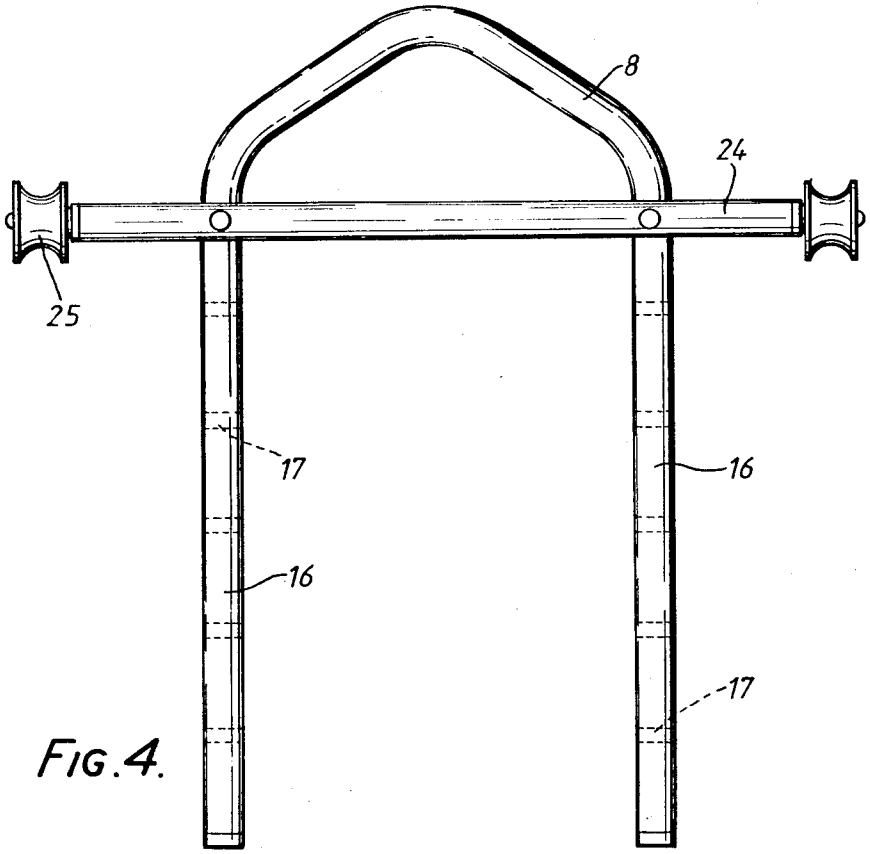
FIG. 4 is an enlarged view of a carrying yoke for the apparatus.
Figure 5:
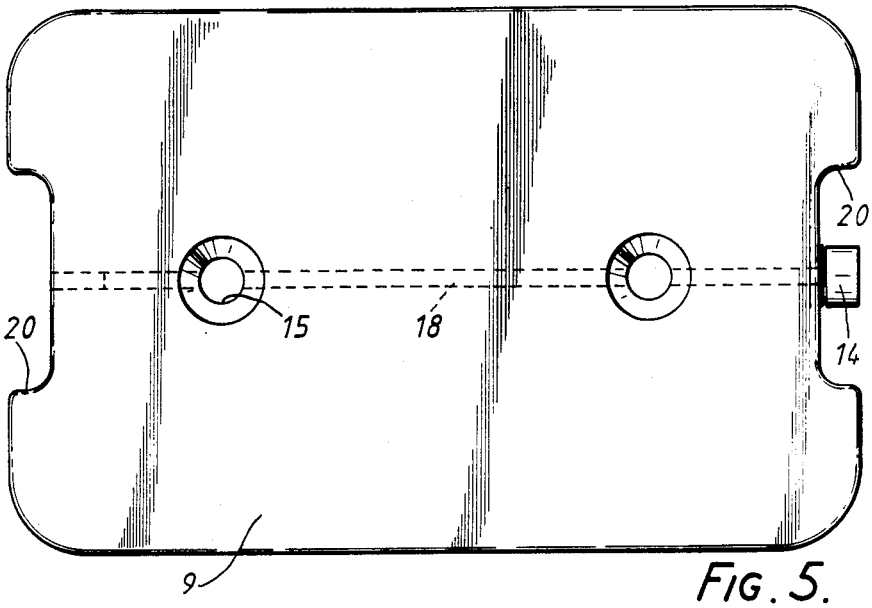
FIGS. 5 and 6 are respectively plan and side views of a weight member mounted on the apparatus.
Figure 6:
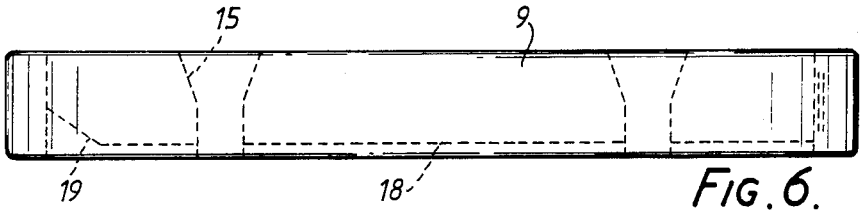

A weight member 9 is illustrated in more detail in FIGS. 5 and 6. This comprises a closed container formed from a rigid plastics material and having a filling opening closed by a removable cap 14. In its unfilled state the weight member will be relatively light, which is an aid to transportation. However once the weight member is filled (for example with water or sand) it will have an appreciable weight. The capacity of the weight member will be such that, when filled with water it will have a predetermined standard weight. The user can modify the weight of the weight member as desired by filling it to a required level with water or sand. The weight member 9 incorporates a pair of passageways 15 which receive the arms 16 of the yoke 8. These arms 16 incorporate a sequence of five aligned holes (indicated generally at 17 in FIG. 4) through which a locating rod may be passed. This rod will slide below the relevant weight member 9 and will be received in a groove 18 formed across the undersurface of the weight member. The mouth of this groove 18 is enlarged at 19 to assist in the insertion process. The user is therefore able to choose any combination of 1 to 5 weight members by inserting the locating rod through the relevant pair of holes 17 in the yoke 8. It will be noted that the end walls of the weight member 9 incorporate recesses 20 which receive the guide tubes 10 and 11 (as shown in FIGS. 1 and 3). This ensures that the weight members 9 travel smoothly up and down within the framework 1. It is possible that the yoke member 8 might tilt as it is lowered (particularly when only one weight member 9 is supported) so that the arms 16 might not properly locate within the passageways 15 in the remaining weight members 9 which could cause damage. Extension pieces 24 carrying rollers 25 are therefore attached to the yoke member 8, the rollers 25 running on the guide tubes 10 and 11 so as to maintain the yoke member 8 always in an upright condition.

Figure 7:
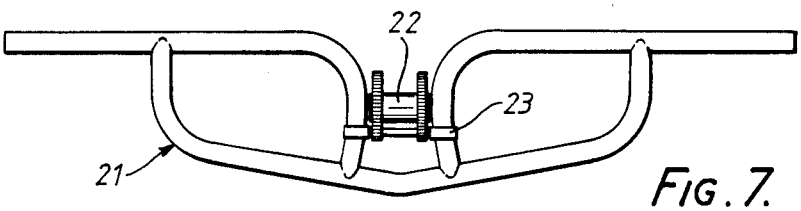
FIGS. 7 and 8 are respectively an underneath plan view and a front view of a handlebar device for operating the equipment shown in FIGS. 1 to 3.
Figure 8:
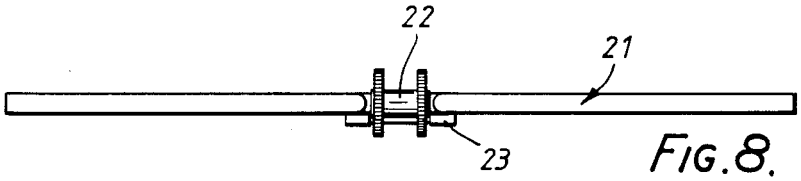

The handlebar device shown in FIG. 7 comprises a framework 21 providing a variety of possibilities for gripping the handlebar device or supporting it by the ankles or other parts of the body of the user. In the centre of the framework 21 there is provided a rotatable reel 22 to which the free end of the nylon cord 7 can be attached. This can be achieved by providing a fixed loop on the reel 22, to which a toggle at the end of the cord 7 can be releasably connected. The loop will be swaged with an aluminium ferrule to avoid slippage. Any excess length of the cord 7 which is not required can be rolled up onto the reel 22 which will then be fixed in the desired position by a removable locating pin 23.

It is envisaged that the main framework 1 will be constructed from a number of detachable parts enabling the equipment to be stored in a flat condition for transportation. The parts of the framework may carry interlocking members enabling the framework to be assembled rapidly and securely. The weight members 9 can be formed from polypropylene material. If necessary the weight members could be mounted on separate or integral lower metal plates, these plates incorporating a guide groove on the underneath surface to receive the locating rod passing through the holes 17 in the yoke member 8. This would protect the plastic weight members 9 from undue shock. It is also possible to form the weight members 9 in a U-shape when viewed from the side so as to receive smaller weight members which will fit within the recess defined by the U-shape. This adds variety to the weight combinations which can be raised by the apparatus. Both the larger U-shape weight members and the smaller ones nesting therewithin would be capable of being interconnected with the yoke member 8 by means of the locating rod passing through relevant pairs of holes 17. The length of the yoke member 8 and the number of pairs of holes 17 may be modified as desired to enable more weight members 9 to be carried.

I claim:

1. An exercising apparatus comprising a support framework defined by guide rods extending upwardly in pairs on both sides of the framework, a carrying member having a pair of downwardly extending arms with aligned passageways defined therethrough at various heights, at least one locating rod for receipt within said passageways, weight members, each of which comprises a body in the form of a hollow container provided with a removable closure cap, and constructed from a rigid plastics material, each weight member being formed with side and end walls, a top surface and an underneath surface, passageways defined through from the one surface to the other for receipt of the pair of arms of the carrying member, recesses define at the sides of the body to accommodate the pairs of upwardly extending guide members, so that the weight member is positioned between the guide members and is stabilized thereby, and a guideway defined in the lower surface of each body for receipt of the locating rod which will be attached to the arms of the carrying member so as to support at least some of the weights, the carrying member, interconnected with at least some of the weight members by the locating rod, being attached to a lifting cable.

2. A weight member according to claim 1, wherein the guideway is defined by a groove running across the lower surface of the body.

3. An exercising apparatus according to claim 1, wherein the carrying member has rollers mounted thereon to run on the pairs of rods.

4. An exercising apparatus according to claim 1, including a handlebar device attached to the end of the lifting cable.

5. An exercising apparatus according to claim 4, wherein the handlebar device includes a reel, on which can be wound any excess length of the cable and having a locking pin for securing the reel in a desired condition.

6. An exercising apparatus according to claim 5, wherein the reel carries a loop within which is releasably attached a toggle at the free end of the cable.

* * * * *